US005898559A

United States Patent [19]

Smith

[11] Patent Number: 5,898,559

[45] Date of Patent: Apr. 27, 1999

[54] APPARATUS AND METHOD FOR NEUTRALIZING STATIC ELECTRICAL CHARGES IN GAS PIPELINE

[75] Inventor: Dirk S. Smith, Boca Raton, Fla.

[73] Assignee: Ionix Technologies, Inc., Boca Raton, Fla.

[21] Appl. No.: 08/890,843

[22] Filed: Jul. 10, 1997

[51] Int. Cl.[6] ..... H05F 3/00

[52] U.S. Cl. ..... 361/215; 361/212; 361/220

[58] Field of Search ..... 361/212, 213, 361/214, 215, 220, 225, 226, 230, 231, 229

[56] References Cited

U.S. PATENT DOCUMENTS

| | | | |
|---|---|---|---|
| 2,326,631 | 8/1943 | Fischer | 361/213 |
| 3,619,718 | 11/1971 | Leonard | 361/215 |
| 3,784,876 | 1/1974 | De Gaston | 361/215 |
| 3,793,558 | 2/1974 | Lindsay et al. | 361/213 |
| 3,943,273 | 3/1976 | de Putter . | |
| 4,057,071 | 11/1977 | Rhodes | 361/215 |
| 4,635,162 | 1/1987 | McLaughlin . | |
| 5,010,440 | 4/1991 | Endo . | |
| 5,173,333 | 12/1992 | Tranbarger . | |
| 5,402,304 | 3/1995 | Smith . | |
| 5,557,820 | 9/1996 | Belanger . | |

*Primary Examiner*—Fritz Fleming
*Attorney, Agent, or Firm*—Malin, Haley, DiMaggio & Crosby, PA

[57] ABSTRACT

An apparatus and method for neutralizing electrostatic charges in non-conductive pipe, such as polyethylene pipe used in natural gas pipelines, which provides a simple and inexpensive apparatus and method to discharge, or otherwise neutralize, electrostatic charges in existing, as well as new, pipelines without requiring specialized pipe or extensive modification of existing pipelines. An apparatus according to the invention includes a housing having inlet and outlet openings and defining a hollow interior portion containing an anti-static cartridge having a cationic substance associated therewith, which, when installed in-line in a gas pipeline, functions to disperse microscopic cationic particles into the gas stream, which particles are carried through downstream pipeline components and neutralize static electrical charges accumulating on said pipeline components.

13 Claims, 4 Drawing Sheets

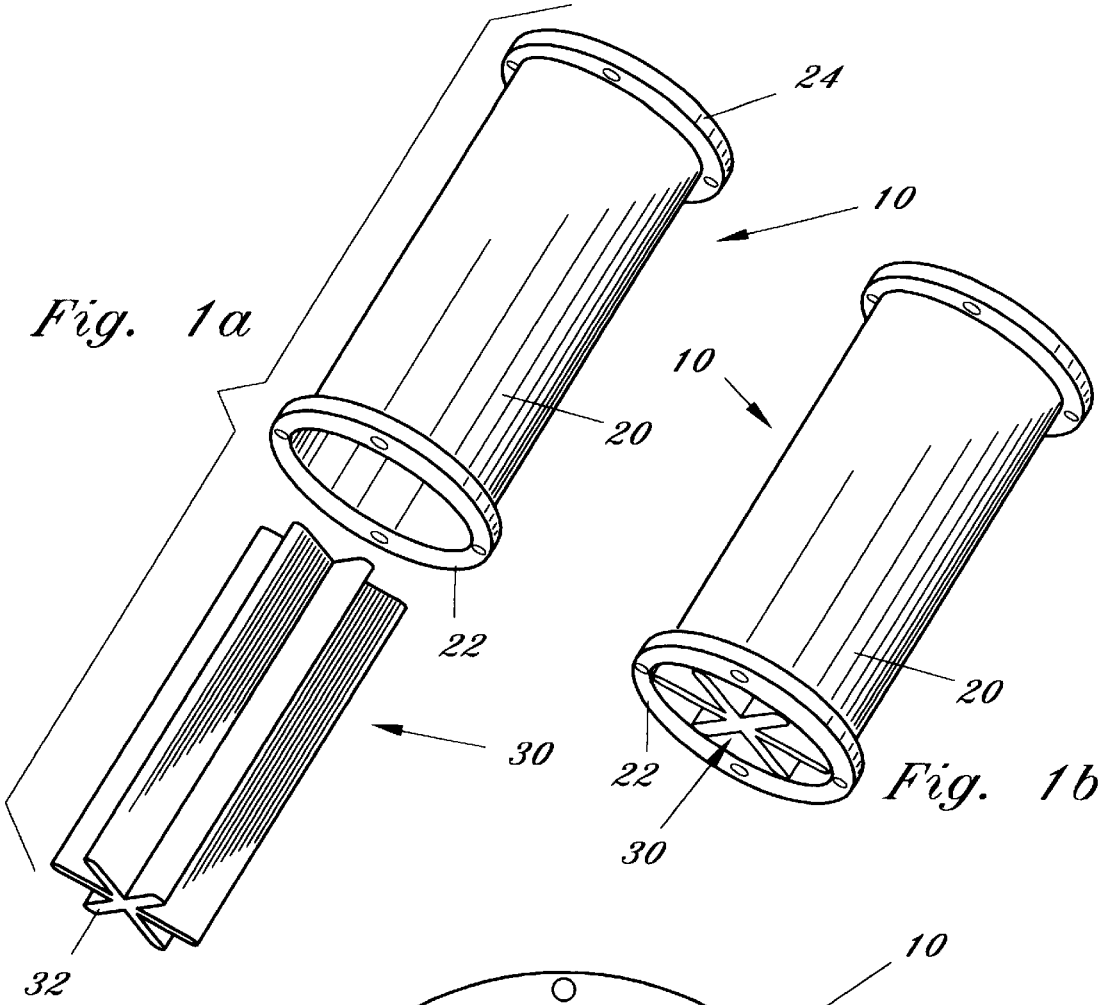
Fig. 1a
Fig. 1b
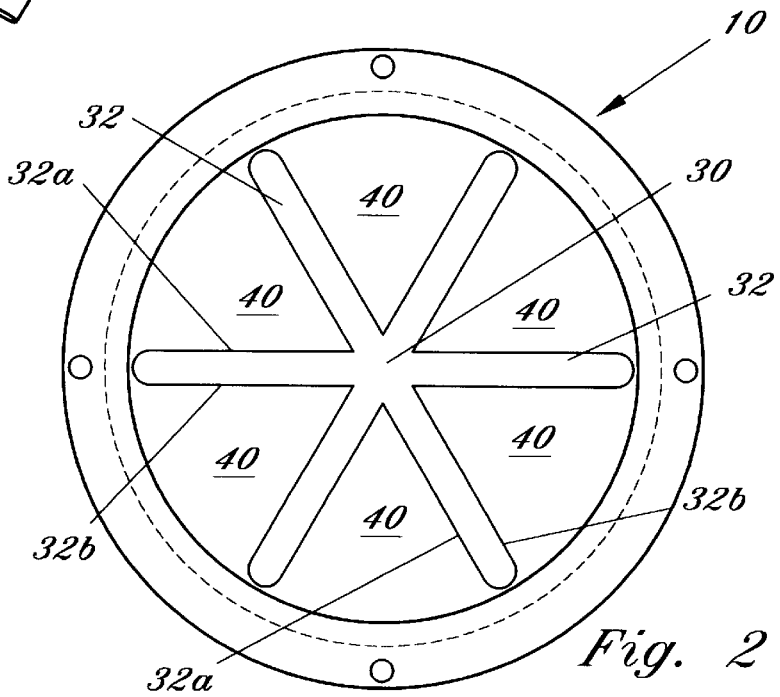
Fig. 2

APPARATUS AND METHOD FOR NEUTRALIZING STATIC ELECTRICAL CHARGES IN GAS PIPELINE

BACKGROUND OF THE INVENTION

1. Field of the Invention

This invention relates to pipelines wherein static electrical charges are present, and more particularly, to an apparatus and method for eliminating the build-up of static electrical charges in gas pipelines.

2. Description of the Background Art

The use of pipelines for transporting fluids, such as natural gas, is well known in the art. Such pipelines typically comprise a series of interconnected sections of pipe and fittings through which a fluid, typically consisting of liquid or gas, flows. The majority of modern gas distribution pipeline installations are fabricated from polyethylene pipe (hereinafter "PE pipe"). It has been estimated that there is about 350,000 miles of plastic pipe in gas distribution service in the U.S. and a substantial portion of that is PE piping.

One major problem with the use of PE pipe is relates to the electrical insulating properties of polyethylene. Specifically, gas flowing through a pipeline is capable of generating static electrical charges thereby creating an electrical potential in non-grounded, or electrically insulated sections of the pipeline, in a process known as triboelectrification. Specifically, when two relative electrical insulators rub against one another (e.g. gas and polyethylene), electrons are displaced from one molecule to another due to friction. Thus, when gas and particulate flow through PE pipe, electrons are displaced and have been found to accumulate on the inside wall of the pipe. Since the PE pipe has a high surface resistivity (electrical resistance), accumulating electrons are unable to dissipate to ground, and therefore generate varying voltage potentials between the inner and outer pipe surfaces. There does not appear to be a predictable pattern to charge accumulation. It has been found that voltages as high as 9000 volts may accumulate in PE pipe.

In pipelines fabricated from non-conductive materials the non-conductive nature of the piping materials prevents discharge by grounding. Thus, unless the static electrical charge is discharged by grounding, or otherwise neutralized, the voltage potential between the inner and outer pipe surfaces may reach levels sufficient for arcing to occur. The spark created when an electrostatic potential arcs represents a serious danger of explosion or fire, particularly when the fluid within the pipeline is flammable, or where the pipeline is in an otherwise hazardous environment. Furthermore, the electrostatic charge build-up in non-conductive pipe presents a hazardous problem to pipeline workers attempting to repair damaged pipelines, particularly those pipelines carrying flammable fluids such as natural gas. It has been found that the build-up of electrostatic charges can cause electrical shock to personnel that come in contact with a charged pipeline as well as triggering a fire and explosion when discharged by arcing.

In addition, the buildup of static electrical charges on the inside walls of PE pipe may cause arcing through the pipe wall resulting in the formation of a relatively small hole, commonly referred to as a "pinhole". As gas passes through buried PE pipe, voltages build up to a point exceeding the dielectric of the pipe causing arcing to occur between the inside and outside wall of the PE pipe as the electrons pass therethrough to ground. As is apparent, the presence of pinholes in natural gas pipe is highly undesirable. However, until technology is available to prevent the buildup of static electricity in the pipe the problems associated with arcing and pinholing persists.

The background art reveals a number of attempts directed to overcoming the dangers and problems associated with the presence of static electrical charges in pipelines. Most attempts, however, are limited to eliminating accumulated static electrical charges. Such attempts are not ideal, since it is difficult to determine whether static electrical charges have accumulated to problematic levels. For example, U.S. Pat. No. 3,943,273, issued to de Putter, discloses an electrically conducting plastic pipe system comprising a male plastic pipe part and a female plastic pipe part with conducting covering layers which are interconnected by means of a conducting sealing ring. The conducting components function to discharge static electrical charges by providing an electrically conductive path to ground.

U.S. Pat. No. 4,635,162, issued to McLaughlin, discloses conductive flanges for pipe fittings comprising a non-conductive flange including at least one strand of conductive yarn in conductive contact with the conduit and extending to the flange rim where it intersects one or several bolt holes. The flange is conductively attached to the conduit such that any static electrical charges are conducted by the yarn to the mounting. bolt, or bolts, disposed in the bolt holes. The bolts are grounded for discharging the potential by grounding the static charge thereby preventing sparking.

U.S. Pat. No. 5,173,333, issued to Tranbarger et al., discloses an apparatus and method for discharging static electricity on the internal surface of plastic pipe. Tranbarger's apparatus and method include providing a saddle for mounting on a section of pipe and a shaft having a cutter for penetrating the pipe upon engagement. The shaft also has a nozzle formed adjacent to the cutter for spraying an anti-static fluid into the plastic pipe for discharging or otherwise neutralizing static electricity. The devices and methods of the background art, however, possess a number of significant disadvantages. For example, the devices disclosed by de Putter and McLaughlin include complex pipe structures which are difficult to fabricate and thus have not realized great commercial success. Furthermore, those devices are not readily adaptable to discharge static electrical charges in existing pipelines without requiring the replacement of large sections of pipeline or pipe fittings. In addition, the device disclosed by Tranbarger et al. is affixed external to the pipeline and requires that the pipe be penetrated thereby breaching the integrity of the pipeline. Furthermore, since the Tranbarger et al. device is affixed external to the pipeline it is subject to damage, and, should the device become dislodged, the pipeline is subject to substantial leakage. Lastly, the Tranbarger device requires a complicated and unreliable mechanical device for injecting an anti-static fluid into the plastic pipe.

In U.S. Pat. No. 5,402,304, the present inventor has addressed the problem of neutralizing static charges which build up between sheets of paper stock, which patent is hereby incorporated herein by reference. That patent discloses an apparatus for eliminating static buildup in paper stock used within a paper handling machine, wherein an anti-static air enhancer cartridge is inserted in an airstream. The airstream passes across the enhancer cartridge where positively charged ions are released into the airstream. The positively charged ions are directed toward a supply of paper stock to neutralize static electrical charges associated therewith.

There still exists a need, however, for an apparatus and method for preventing the accumulation of static electrical charges on the inner surfaces of non-conductive gas pipe, which apparatus and method is adaptable to new as well as existing pipelines.

SUMMARY OF THE INVENTION

The present invention provides a method and apparatus for preventing the accumulation of static electrical charges in non-conductive pipe, such as PE pipe used in gas pipelines. The invention provides a simple and inexpensive apparatus and method to neutralize static electrical charges in existing, as well as new, pipe without requiring that the pipeline be fabricated from complex specialized pipe, and without requiring extensive modification of existing pipelines.

An apparatus according to the invention includes a housing having inlet and outlet openings and containing an anti-static cartridge configured to allow for the flow of gas through the housing while being exposed to surfaces of the cartridge. The housing may comprise a relatively short section of cylindrical pipe adapted for in-line insertion in a pipeline. In the preferred embodiment, the anti-static cartridge may be installed in a top loading natural gas filter housing. Gas flowing through the housing is exposed to the anti-static cartridge and collects trace amounts of cationic microscopic particulates therefrom. The anti-static cartridge thus functions to disperse particles into the gas which particles are carried through the gas pipeline by the gas stream. The particles effectively neutralize negative static electrical charges in the downstream pipeline components by attracting electrons from the inner pipe surface thereby substantially reducing and/or totally eliminating static electrical charges such that the aforementioned hazards associated with static charge build-up are substantially eliminated.

According to another aspect of the invention, a method is provided for neutralizing static electrical charges in gas pipelines by enhancing the gas stream within the pipeline with microscopic particles which neutralize the triboelectrification generated static electrical charges generated by the gas stream. The method includes exposing at least a portion of the gas flowing through a pipeline to an anti-static material whereby the gas stream passes over material having a relatively large surface area with releasable cationic particulate matter thereon. The unique chemical composition of the anti-static material allows the release of a predetermined amount of particles from the material as the gas stream passes thereacross. The particles are carried from the housing by the gas stream through the downstream piping where they attract electrons from the negatively charged inner pipeline surfaces thereby neutralizing static electrical voltages accumulating on the inner surfaces of non-conductive (e.g. PE) pipe.

In the preferred embodiment, the anti-static material defines a multi-sided structure having a predetermined surface area that may be formed from any suitable rigid material, such as a non-porous, woven polyester or paper. An example is an elongate structure having a star-like cross-section thereby forming a plurality of spoke-like panel members, each having opposing sides radially projecting from a central axis, and each providing opposing surfaces exposed to the gas (hereinafter "cartridge"). The cartridge surfaces are coated with a cationic quaternary ammonium compound, containing a rheological additive, which completely coats the rigid framework of the non-porous, woven material. Other representative chemicals include quaternary ammonium compounds and amines, dialkyl dimethel ammonium chlorides, quarternary imidazolinium salts. Examples of a rheological additive would be inert substances such as smectite type clay, and hydrophilic laponite clay.

One or more housings, each containing an anti-static cartridge, may be installed in series or parallel in-line in a gas pipeline such that gas flowing through the pipeline is exposed to the cartridge by entering the housing inlet and exiting the housing outlet. The longitudinal axis of the star shaped cartridge structure is aligned axially with an axis formed by the housing, so that gas entering the housing is directed uniformly over all surfaces of the cartridge, thus allowing for maximum charge accumulation by the fluid prior to its exiting the housing outlet.

Although the primary objective is to use the present invention with non-conductive piping, it has been determined that the invention is suitable for use with a wide variety of applications and processes wherein it is desirable to neutralize or eliminate static electrical charges.

Accordingly, it is an object of the present invention to provide an apparatus and method, for use in a wide variety of environments, to neutralize static electrical charges.

It is a further object of this invention to provide an apparatus and method for neutralizing static electrical charges, especially useful with gas pipelines, for substantially neutralizing electrostatic charges associated therewith.

It is another object of this invention to provide an apparatus and method for adding microscopic charge eliminating particles to a gas stream.

Still another object of this invention is to provide an anti-static cartridge device for neutralizing static electrical charges in natural gas pipelines which can be installed in an existing in-line filter housing.

In accordance with these and other objects which will become apparent hereinafter, the instant invention will now be described with particular reference to the accompanying drawings.

BRIEF DESCRIPTION OF THE DRAWINGS

FIG. 1*a* is an exploded side perspective view of a preferred embodiment of an apparatus according to the present invention;

FIG. 1*b* is a side perspective view of the apparatus depicted in FIG. 1*a;*

FIG. 2 is an end view of the apparatus depicted in FIG. 1*b;*

DESCRIPTION OF THE PREFERRED EMBODIMENTS

Figure 3A:
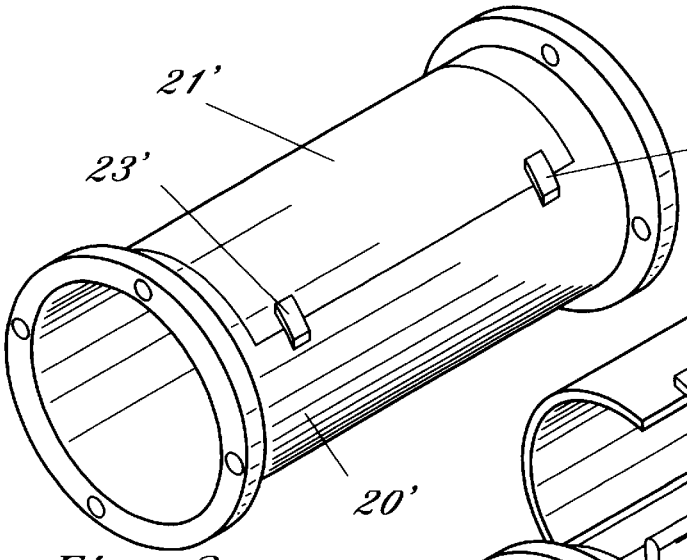
FIG. 3*a* is a side perspective view of an alternate embodiment of an apparatus according the present invention.

FIGS. 1*a* and 1*b* depict perspective views of a preferred embodiment of an apparatus according to the present invention, generally referenced as 10. In the preferred embodiment, apparatus 10 includes a cylindrically-shaped housing 20, defining a hollow interior gas passageway, and having an inlet end 22 and an outlet end 24. A chemically treated anti-static cartridge 30 is installed within housing 20 and configured to allow for the flow of gas through the housing while being exposed to the cartridge.

Housing 20 may comprise a relatively short section of pipe adapted for insertion in-line in a pipeline such that gas flowing through the housing passes across surfaces of the anti-static cartridge 30. Housing 20 may also comprise a conventional natural gas filter housing, such as the type manufactured by Safeco of Broken Arrow, Okla., and identified as GFT series—top loading natural gas filters, in which case cartridge 30 may be of any configuration suitable for installation therein. Housing 20 may be of any suitable shape and may have flanged ends, as depicted in FIGS. 1*a* and 1*b*, to facilitate in-line connection to other pipeline components. Furthermore, the housing inlet and outlet ends, 22 and 24 respectively, may be of any suitable shape to facilitate installation of housing 20, containing cartridge 30, in-line in a piping system.

As best depicted in FIG. 2, in the preferred embodiment, anti-static cartridge 30 defines a multi-sided structure having a predetermined surface area and may be formed from any rigid material, such as a non-porous, woven polyester or paper. In the preferred embodiment depicted in FIG. 2, anti-static cartridge 30 comprises an elongate structure having a star-like cross-section thereby forming a plurality of spoke-like panel members 32, each having opposing side surfaces, referenced as 32*a* and 32*b* respectively, radially projecting from a central axis.

In the preferred embodiment, cartridge 30 is axially disposed within housing 20 such that spoke-like panel members 32, and particularly opposing side surfaces 32*a* and 32*b*, cooperate with the cylindrical inner surface of housing 20 and adjacent cartridge surfaces to form individual gas flow channels, referenced as 40. Each flow channel 40 is thus defined by two opposing surfaces of the spoke-like panel members 32 and a portion of an inner surface of housing 20, such that a substantial amount of the housing's internal net free area is maintained to allow gas to flow through housing 20, via flow channels 40, without experiencing a significant pressure loss or reduction in flow velocity.

Figure 3B:
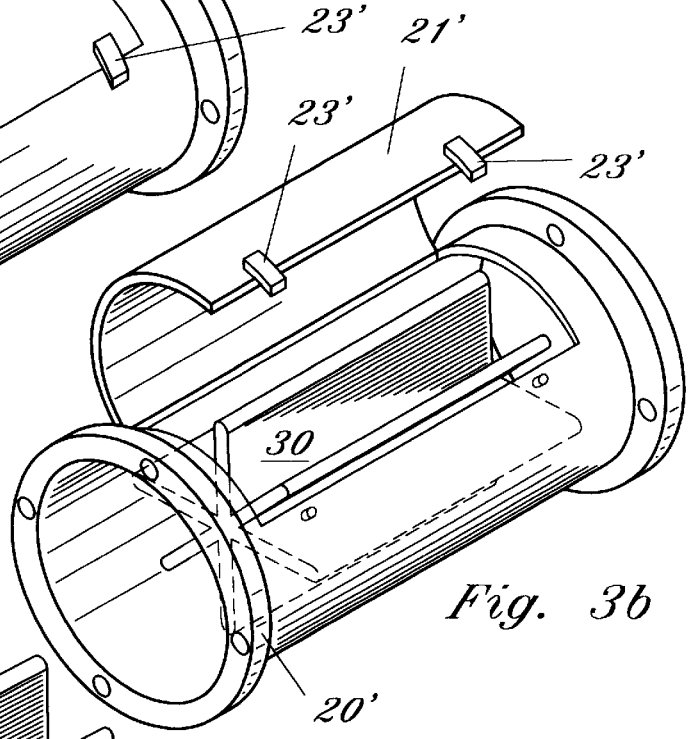
FIG. 3*b* is a side perspective view of the alternate embodiment depicted in FIG. 3*a;*
Figure 3C:
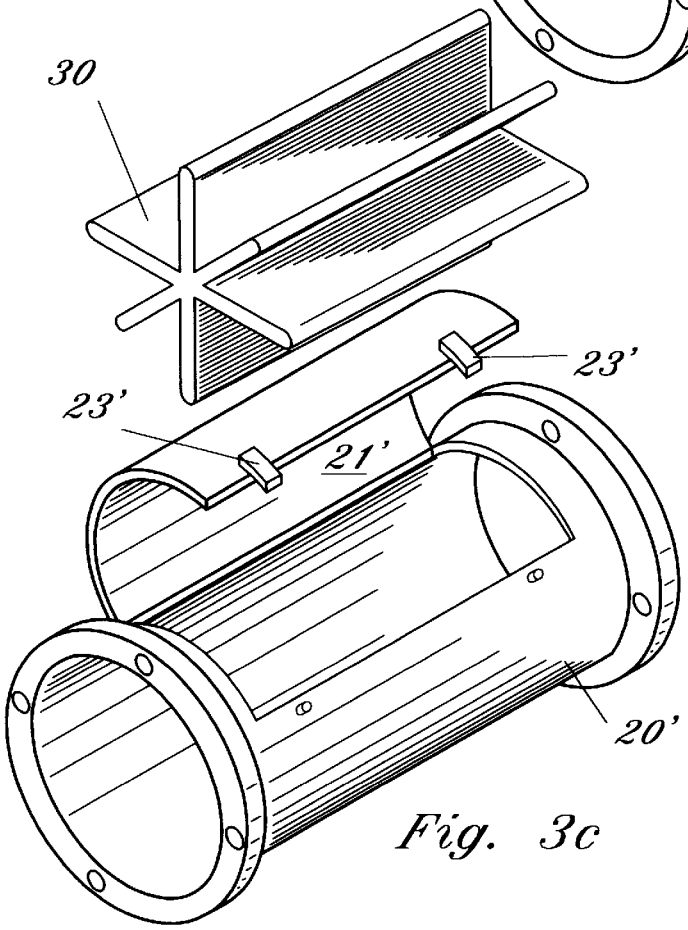
FIG. 3*c* is an exploded side perspective view of the alternate embodiment depicted in FIGS. 3*a* and 3*b;*

An alternate embodiment housing, generally referenced as 20' is depicted in FIGS. 3*a*, 3*b* and 3*c*. In this alternate embodiment housing 20' includes a removable closure or access panel 21' which can be selectively opened and closed for facilitating the selective removal and/or replacement of cartridge 30. Access panel 21' may be locked in a closed position by latching mechanisms 23', fasteners (not shown), or any structure with allows for the removal and/or replacement of cartridge 30, while providing a hermetic seal is considered within the scope of the invention.

In an embodiment directed to neutralizing negative static electrical charges, cartridge 30 is coated, or otherwise impregnated, with an ionic chemical composition such as a cationic quaternary ammonium compound, containing a rheological additive, which substantially coats the rigid framework of the non-porous, woven material. Other suitable representative chemicals include quaternary ammonium compounds and amines, dialkyl dimethel ammonium chlorides, quarternary imidazolinium salts. Examples of a rheological additive would be smectite type clay, and hydrophilic laponite clay. While the above-referenced substances have been specifically disclosed herein, it should be apparent that the instant invention contemplates the use of any suitable substances which would not adversely affect the gas or the pipeline components.

Cartridge 30 functions to disperse micoscopic particles into the gas stream flowing across the cartridge surfaces. Specifically, when housing 20 (or alternatively 20') is installed in-line in a gas pipeline, gas flowing through the housing, and more particularly through channels 40, is exposed to cartridge surfaces 32*a* and 32*b* thereby causing the gas to collect trace amounts of microscopic particles by entrainment. The particle containing gas continues to travel through the pipeline and the particles effectively neutralize negative static electrical charges in the downstream pipeline components by attracting and removing electrons from the inner surfaces of the pipe thereby eliminating the aforementioned problems associated with static electrical charges.

Figure 4A:
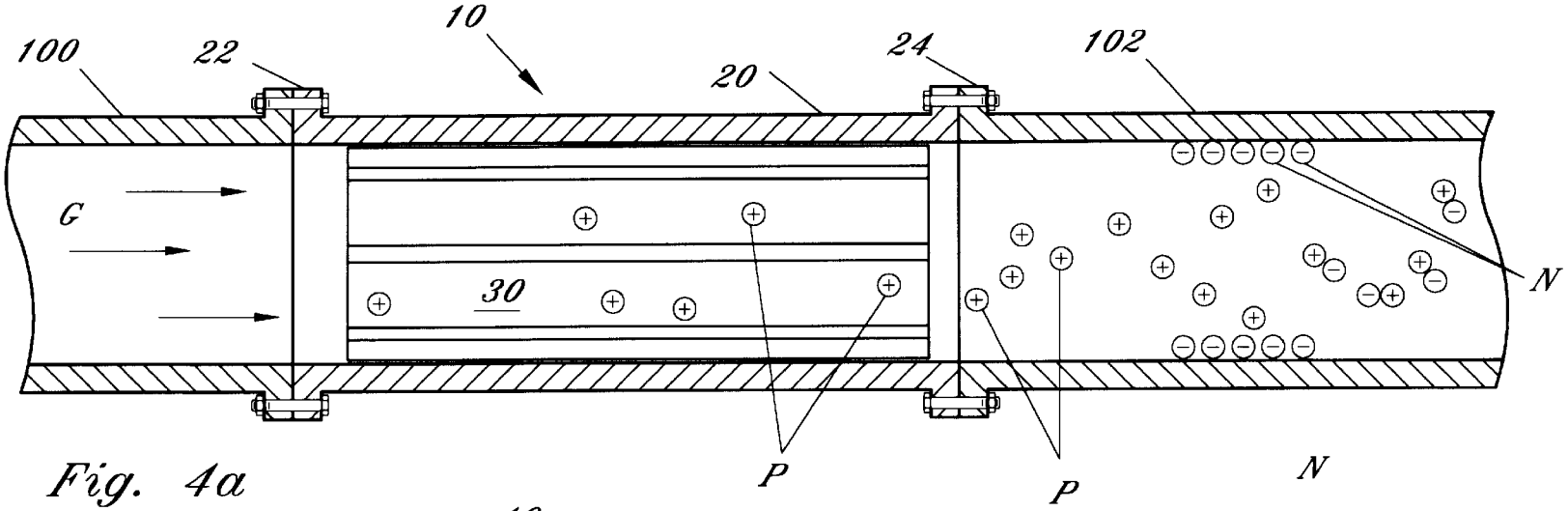
FIG. 4*a* is a side sectional view of a preferred embodiment of an apparatus according to the present invention installed in a pipeline.
Figure 4B:
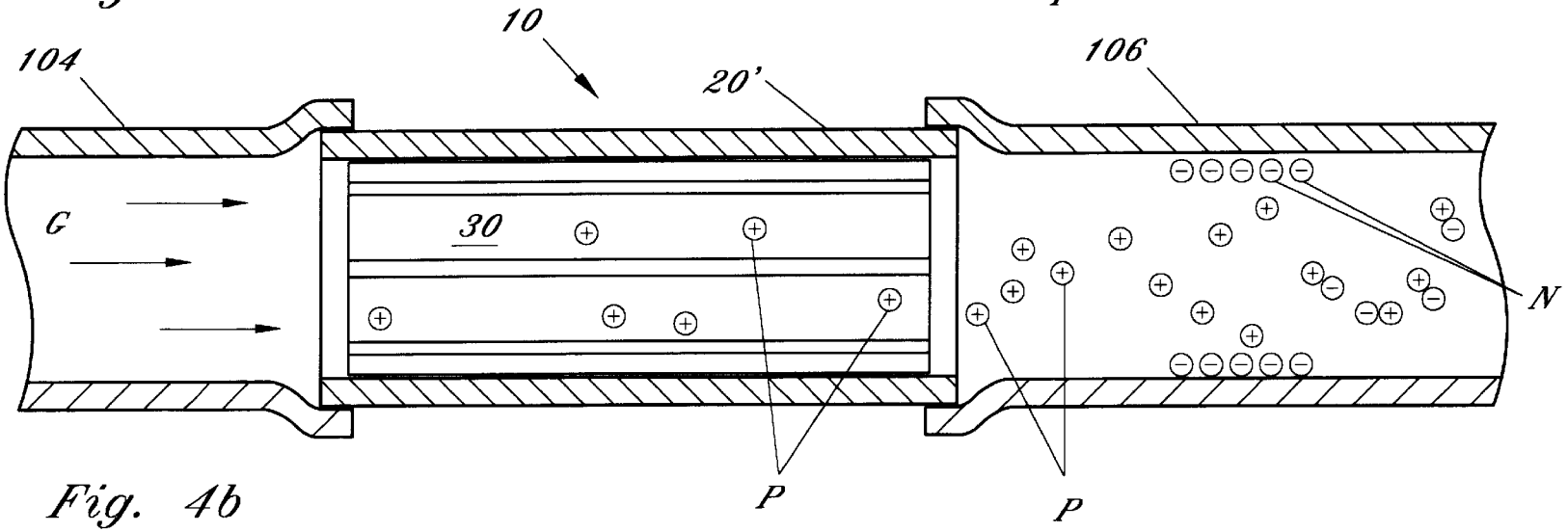
FIG. 4*b* is a side sectional view of an alternate embodiment of an apparatus according to the present invention installed in a pipeline.

As best depicted in FIGS. 4*a* and 4*b*, the unique ionic chemical composition of the anti-static cartridge within the housing allows a limited number of positively charged particles, generally referenced as "P", to be released from the material as the gas stream passes thru housing 20 (or 20') and is exposed to cartridge 30. Flanged housing 20 may be installed in-line in a pipeline and disposed between flanged pipe sections 100 and 102 as best depicted in FIG. 4*a*; or, a non-flanged housing 20' may be installed in-line in a pipeline and disposed between pipe sections 104 and 106 in a male/female type connection configuration. As is apparent, any suitable housing structure and connection configuration is considered within the scope of the invention.

The positively charged particles "P" are carried by the gas stream, generally referenced as "G" from the housing through the downstream piping where they attract electrons from negatively charged inner pipeline surfaces, thereby removing the electrons from the pipeline surfaces and neutralizing any static electrical charge which has built-up on the inner surfaces of the pipeline.

Figure 5:
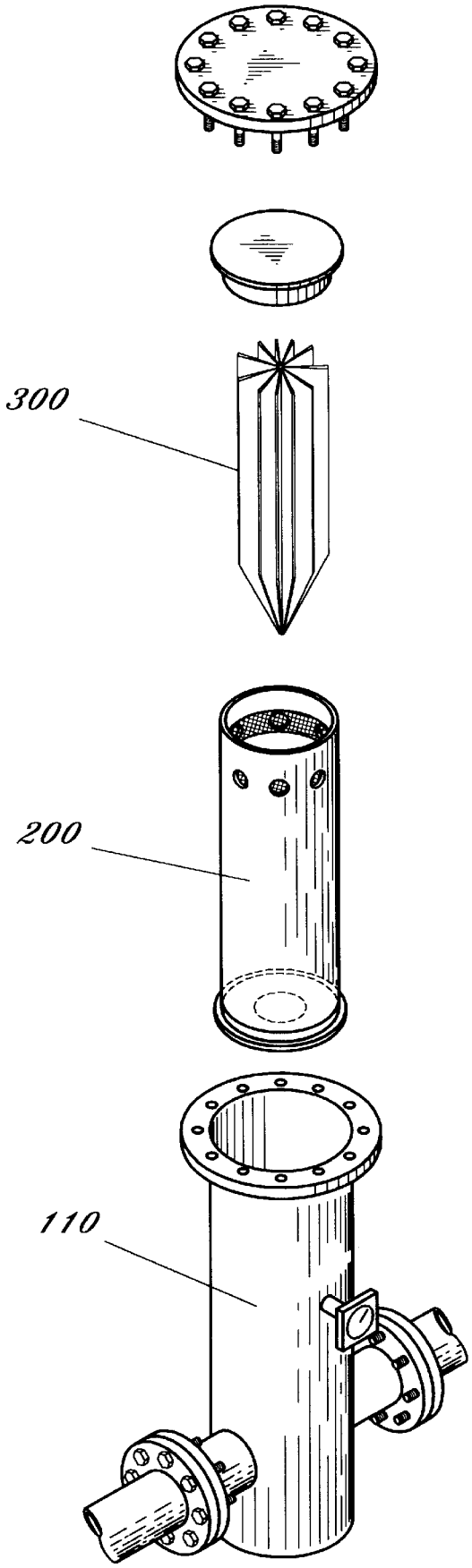
FIG. 5 is an exploded view of an embodiment of the present invention for use with a natural gas filter structure.

As best depicted in FIG. 5, a cartridge 300 and housing 200 may be configured for installation in a conventional natural gas filter structure, generally referenced as 110, in an existing pipeline. Accordingly, cartridges 300 and housings 200 may be fabricated to industry standard size specifications for use with natural gas filter structures 110, in lieu of, or in addition to, conventional particulate filters.

According to another aspect of the invention, a method is provided for neutralizing static electrical charges in pipelines by dispersing microscopic particles within the gas flowing in the pipeline for neutralizing downstream static electrical charges.

The method includes: (1) forming an anti-static cartridge including an ionic chemical composition such as a cationic quaternary ammonium compound; (2) inserting the anti-static cartridge in-line in a gas pipeline; (3) exposing the gas stream, flowing through the pipeline, to the anti-static cartridge by causing at least a portion of the fluid stream to pass over the material whereby microscopic particles are released into the gas stream; (4) allowing the particle containing gas stream to flow through downstream non-conductive pipeline components whereby electrons associated with the accumulation of static electrical charges are attracted away from the inner surfaces of the pipeline components.

The present invention contemplates that a sufficient number of apparatuses 10 may be installed in a pipeline and suitably spaced such that electrostatic charges may be neutralized over an entire pipeline, regardless of length. Furthermore, a plurality of apparatuses may be installed in a spaced series configuration, or a plurality of apparatuses may be installed in one general location in a parallel configuration thereby multiplying the static charge eliminating effect.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus connected to a natural gas electrically non-conductive pipeline to reduce and neutralize static electrical charges present in the pipeline, said apparatus comprising:

an electrically non-conductive natural gas inlet pipe;

an electrically non-conductive natural gas outlet pipe;

a housing means having a natural gas inlet and a natural gas outlet, said housing fluidly connected to said natural gas inlet pipe and said natural gas outlet pipe whereby gas flows through said housing from said housing inlet to said housing outlet;

at least one cartridge disposed within said housing, said cartridge including a chemical compound for dispersing cationic particles throughout said natural gas flowing through said housing, whereby said cationic particles flow through said natural gas outlet pipe and neutralize static electrical charges associated therewith.

2. An apparatus according to claim 1, wherein said housing means comprises a natural gas filter housing.

3. An apparatus according to claim 1, wherein said cartridge means includes dispersable cationic particles.

4. An apparatus for use with a natural gas electrically non-conductive pipeline to neutralize static electrical charges present in the pipeline, said apparatus comprising:

a natural gas electrically non-conductive pipeline having an outlet and an inlet;

a housing having a natural gas inlet and a natural gas outlet, said housing being connected in-line to said natural gas pipeline outlet and inlet, whereby natural gas flows through said housing from said inlet to said outlet;

a cartridge mounted within said housing and disposed between said natural gas inlet and said natural gas outlet, said cartridge having at least one surface exposed to natural gas flowing through said housing, said at least one surface including a cationic chemical composition such that natural gas flowing through said housing is exposed to said cationic chemical composition whereby microscopic cationic particles are released from said cartridge into said natural gas pipeline inlet thereby neutralizing static electrical charges present in said natural gas pipeline downstream of said housing.

5. An apparatus for use with a natural gas pipeline according to claim 4, wherein said cationic chemical composition is a cationic quaternary ammonium compound.

6. An apparatus for use with a natural gas pipeline according to claim 5, wherein said cationic quaternary ammonium compound contains a rheological additive.

7. An apparatus for use with a natural gas pipeline according to claim 4, wherein said housing is a natural gas filter housing.

8. An apparatus for use with a natural gas pipeline according to claim 4, wherein said cartridge is removably disposed within said housing.

9. An apparatus for use with a natural gas carrying electrically non-conductive pipeline according to claim 4, wherein said cartridge defines a multi-sided structure having a plurality of surfaces exposed to said fluid and a predetermined surface area.

10. An apparatus for use with a natural gas carrying electrically non-conductive pipeline according to claim 9, wherein said cartridge multi-sided structure has a star-shaped cross section.

11. A method for neutralizing static electrical charges in natural gas electrically non-conductive polyethylene pipelines, said method including the step of:

dispersing microscopic cationic particles into gas flowing through a natural gas polyethylene pipeline, whereby said microscopic cationic particles flow are carried by said gas through downstream pipeline components, whereby said particles neutralize static electrical charges associated with said downstream polyethylene pipeline components.

12. A method for neutralizing static electrical charges in natural gas electrically non-conductive pipelines, said method including the steps of:

(1) forming an anti-static surface including a rheological cationic chemical composition;

(2) inserting said anti-static surface in a suitable housing in a natural gas electrically non-conductive pipeline;

(3) exposing at least a portion of the natural gas flowing through the natural gas pipeline to said anti-static surface whereby microscopic cationic particles are dispersed into said gas;

(4) allowing the cationic particle containing natural gas to flow through downstream pipeline components whereby electrons present on the inner surfaces of said pipeline components are neutralized by said cationic particles.

13. A method for neutralizing static electrical charges in natural gas polyethylene pipelines, said method comprising:

(1) exposing at least a portion of a natural gas stream, flowing through a polyethylene pipeline, to an anti-static material contained within a housing, said housing having a natural gas inlet and a natural gas outlet, said inlet and said outlet being fluidly connected to gas pipeline, whereby natural gas flows through said housing from said inlet to said outlet, said anti-static material disposed within said housing between said inlet and said outlet, said anti-static material having at least one surface exposed to at least a portion of said natural gas flowing through said housing, said at least one surface including a cationic chemical composition such that cationic particles are dispersed to said natural gas flowing through said housing;

(2) allowing the positively charged natural gas stream to exit said polyethylene housing and flow through said polyethylene pipeline whereby the electrically charged natural gas stream neutralizes the oppositely charged polyethylene pipeline.

* * * * *